US005433366A

United States Patent [19]

Deschenes et al.

[11] Patent Number: 5,433,366

[45] Date of Patent: Jul. 18, 1995

[54] DISPENSING OF ATTACHMENTS

[75] Inventors: Charles L. Deschenes, No. Attleboro, Mass.; William J. Cooper, Woonsocket, R.I.; Clark L. Grendol, Sturbridge, Mass.; Hitoshi Kogiso, Mizunami, Japan; Tomoyasu Ito, Mizunami, Japan; Hidekatsu Kimbara, Mizunami, Japan

[73] Assignee: Avery Dennison Corporation, Pasadena, Calif.

[21] Appl. No.: 356,788

[22] Filed: Dec. 12, 1994

Related U.S. Application Data

[63] Continuation of Ser. No. 25,044, Mar. 1, 1993, abandoned.

[51] Int. Cl.[6] ..... B65C 7/00

[52] U.S. Cl. ..... 227/67; 227/76

[58] Field of Search ..... 227/114, 67, 76

[56] References Cited

U.S. PATENT DOCUMENTS

| | | | |
|---|---|---|---|
| 3,734,375 | 5/1973 | Bone et al. | 227/67 |
| 3,815,798 | 6/1974 | Lavitch et al. . | |
| 4,039,078 | 8/1977 | Bone . | |
| 4,179,063 | 12/1979 | Russell | 227/67 |
| 4,448,194 | 5/1985 | DiGiovanni et al. | 227/67 |
| 4,533,076 | 8/1985 | Bourque . | |
| 4,682,721 | 7/1987 | Duchin | 227/67 |
| 4,706,362 | 11/1987 | Strausburg | 227/76 |
| 4,877,172 | 10/1989 | Franklin et al. . | |
| 5,020,713 | 6/1991 | Kunreuther | 227/67 |

*Primary Examiner*—Scott A. Smith

*Attorney, Agent, or Firm*—Kriegsman & Kriegsman

[57] ABSTRACT

A device for dispensing plastic attachments of the type which are formed as part of a roll of continuously connected ladder stock. In one embodiment, the device includes a pair of hollow slotted needles each having a tip, a rear end and a longitudinal axis. A feed wheel, placed proximate to the rear ends of the pair of needles, is used to feed individual attachments of a roll of ladder stock into the pair of needles through their respective rear ends at angles relative to the longitudinal axes thereof. Once inserted into the needles, an attachment is severed from the remainder of the ladder stock by a knife and is then expelled from the needles by a pair of ejector rods movable along the longitudinal axes of the pair of needles. Because attachments are fed into the pair of needles at angles relative to their longitudinal axes, no shuttling of the needles between an attachment feeding position and an attachment ejecting position is required. The pair of needles, the feed wheel, the knife, and the pair of ejector rods are all mounted on a vertically movable head member. An electric motor assembly is used to move the head member between an attachment dispensing position and a withdrawal position. The vertical movement of the head member drives the operation of the feed wheel, the knife and the ejector rods.

7 Claims, 10 Drawing Sheets

DISPENSING OF ATTACHMENTS

This is a continuation of application Ser. No. 08/025,044 filed on Mar. 1, 1993, now abandoned.

BACKGROUND OF THE INVENTION

The present invention relates to the dispensing of attachments and more particularly to the dispensing of attachments from continuously connected ladder stock.

In commonly assigned U.S. Pat. No. 4,039,078, which is incorporated herein by reference, there are disclosed several different types of attachments which are fabricated as part of continuously connected ladder stock. In each instance, the attachment has an H-shape, and the ladder stock is formed from two elongated and continuous plastic side members coupled together by a plurality of plastic cross links, the cross links preferably being equidistantly spaced. The stock may be produced from flexible plastics material including nylon, polypropylene and other similar materials by molding or by stamping. Either manually or with the aid of specifically designed devices, individual attachments may be dispensed from the ladder stock to couple buttons to fabric, mechandising tags to articles of commerce, or, in general, any two desired articles. In those instances where the dispensing device has dual needles, the attachments severed from the stock can be used like staples to secure objects and items.

In commonly assigned U.S. Pat. No. 4,877,172, which is also incorporated herein by reference, a device for dispensing attachments of the type described above is disclosed. The device disclosed therein includes a reciprocatively mounted shuttle which fixedly carries a pair of hollow slotted needles and which moves between an attachment severing position and an attachment dispensing position. A feed belt, which is driven by a pair of sprockets, is sued to incrementally advance the ladder stock so that, at the end of each attachment dispensing cycle, a single attachment is fed into the needles at the attachment severing location. Once the attachment has been fed into the pair of needles, a slidably mounted knife blade severs the attachment from the remainder of the ladder stock, and the shuttle is moved to the attachment dispensing location where the needles are aligned with a pair of plungers. The plungers are then inserted into the needles to expel the attachment therefrom. Thereafter, the plungers retract and the shuttle moves back into the attachment severing location to accept another attachment. The shuttle, feed belt, knife blade and plungers are mounted to a head member. The head member is driven between between an attachment dispensing position and a withdrawn position by an electric motor driven assembly.

Although the aforementioned device has performed reasonably well in the dispensing of attachments, it has certain shortcomings. One such shortcoming is that the device not infrequently causes an attachment to be severed asymmetrically (see, e.g., FIGS. 1A and 1B wherein a properly severed attachment 10*a* and an asymmetrically severed attachment 10*b* are respectively shown), thereby impairing its utility and/or aesthetic value. The principal reason for this undesired asymmetry is that the feed belt, which is used to advance the attachment through a feed drive and into the pair of needels, is separated from the needles by a rather considerable distance of approximately 6 inches. Consequently, if the feed belt does not properly advance the ladder stock over this 6 inch spacing, one or more improperly severed attachments may be formed.

The shuttle mechanism of the above-mentioned device presents another such shortcoming. As noted above, when the device is in use, the shuttle moves back and forth between an attachment severing position and an attachment dispensing position. To properly align the shuttle at each of the aforementioned positions, mechanical stops are strategically placed to limit movement of the shuttle. The stops, however, do not always function with the timing and positional precision required to precisely place the shuttle at its desired location at the appropriate time.

Another pertinent patent is commonly assigned U.S. Pat. No. 4,533,076. This patent, which is also incorporated herein by reference, discloses another such device for dispensing attachments from continuously connected ladder stock.

SUMMARY OF THE INVENTION

It is an object of the present invention to provide a new and novel device for dispensing attachments.

It is another object of the present invention to provide a device as described above which overcomes at least some of the shortcomings described above in connection with existing devices.

It is still another object of the present invention to provide a device as described above which has a minimal number of moving parts.

It is still yet another object of the present invention to provide a device as described above which is easy to assemble and operate and which can be mass produced.

According to one embodiment of the invention, a device for dispensing attachments from ladder stock is provided which comprises a hollow slotted needle having a tip, a rear end and a longitudinal axis, means for feeding an attachment into said hollow slotted needle through said rear end at an angle relative to said longitudinal axis and means for ejecting an attachment disposed within sad hollow slotted needle through said tip.

Preferably, said ejecting means comprises an ejector rod movable along the longitudinal axis of said hollow slotted need. In addition, the angle at which said feeding means feeds an attachment into said hollow slotted needle is preferably large enough so that an attachment can be fed into said hollow slotted needle using said feeding means and can be ejected therefrom using said ejecting means without requiring said hollow slotted needle to be moved laterally relative to said feeding means or said ejecting means. In this way, a shuttling mechanism for the needle (or conversely, for the feeding means and/or the ejecting means) may be eliminated.

The feeding means of the present device preferably comprises a rotatably mounted feed wheel located off-axis of said hollow slotted needle. Said feed wheel preferably has a plurality of teeth which are configured to engage and, thereby, to drive the movement of a length of continuously connected ladder stock. As can readily be appreciated, because said feed wheel is directly mateable with the ladder stock, a feed belt is not needed. It should also be noted that, because said feed wheel is preferably disposed at a distance of approximately 1.125 inches from the rear end of the hollow slotted needle, the above-described problem resulting from a large spacing between the feed belt and the hollow slotted needle of the device of U.S. Pat. No. 4,877,172 is substantially eradicated.

Preferably, the device is also provided with severing means so that, one an attachment from a length of ladder stock has been fed into said hollow slotted needle, said attachment may be severed from the remainder of the ladder stock.

Although the present device may be provided with only a single hollow slotted needle and corresponding ejector rod, the present device is preferably provided with a pair of such needles and corresponding ejector rods. In this manner, one transverse bar of an attachment may be inserted into and expelled from one of the two needles while the other transverse bar of the attachment is being inserted into and expelled from the other of the two needles.

The one or more hollow slotted needles of the present device are preferably movable along their respective longitudinal axes. In addition, the one or more hollow slotted needles, the feeding means, the ejecting means and the severing means are all preferably mounted on a head member which moves between an attachment dispensing position and a withdrawn position. Movement of the head member is preferably driven by an electric motor assembly which preferably includes a clutch means for coupling said electric motor to said head assembly in response to a user command.

Various features and advantages will appear from the description to follow. In the description, reference is made to the accompanying drawings which form a part thereof, and in which is shown by way of illustration, a specific embodiment for practicing the invention. This embodiment will be described in sufficient detail to enable those skilled in the art to practice the invention, and it is to be understood that other embodiment may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate a preferred embodiment of the invention and, together with the description, serve to explain the principles of the invention. In these drawings wherein like reference numerals represent like parts.

DETAILED DESCRIPTION OF PREFERRED EMBODIMENTS

Figure 2:
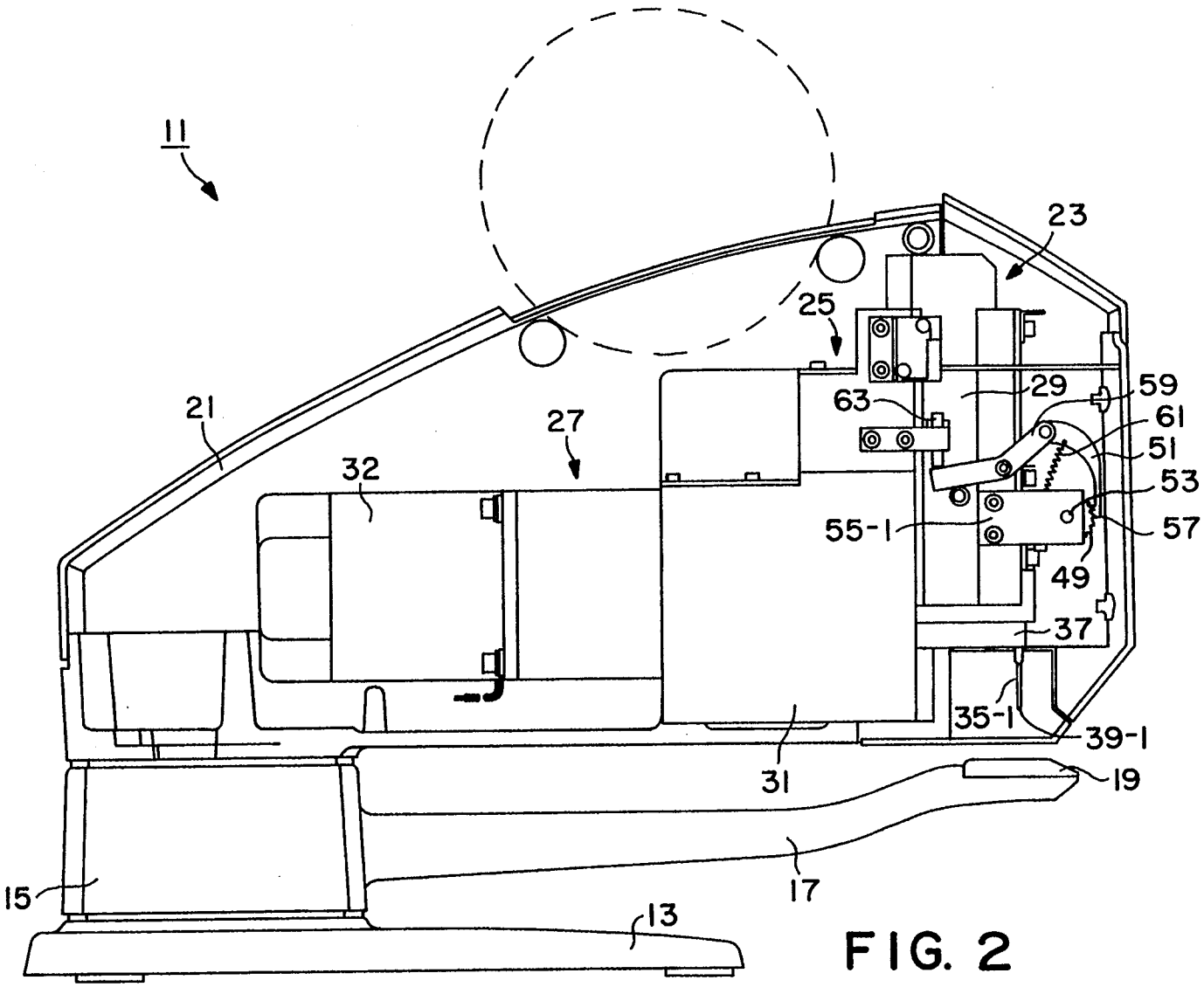
FIG. 2 is a side view of one embodiment of a device for dispensing attachments constructed according to the teachings of the present invention, the device being shown with a side portion of its housing removed to reveal the components contained therewithin.
Figure 3:
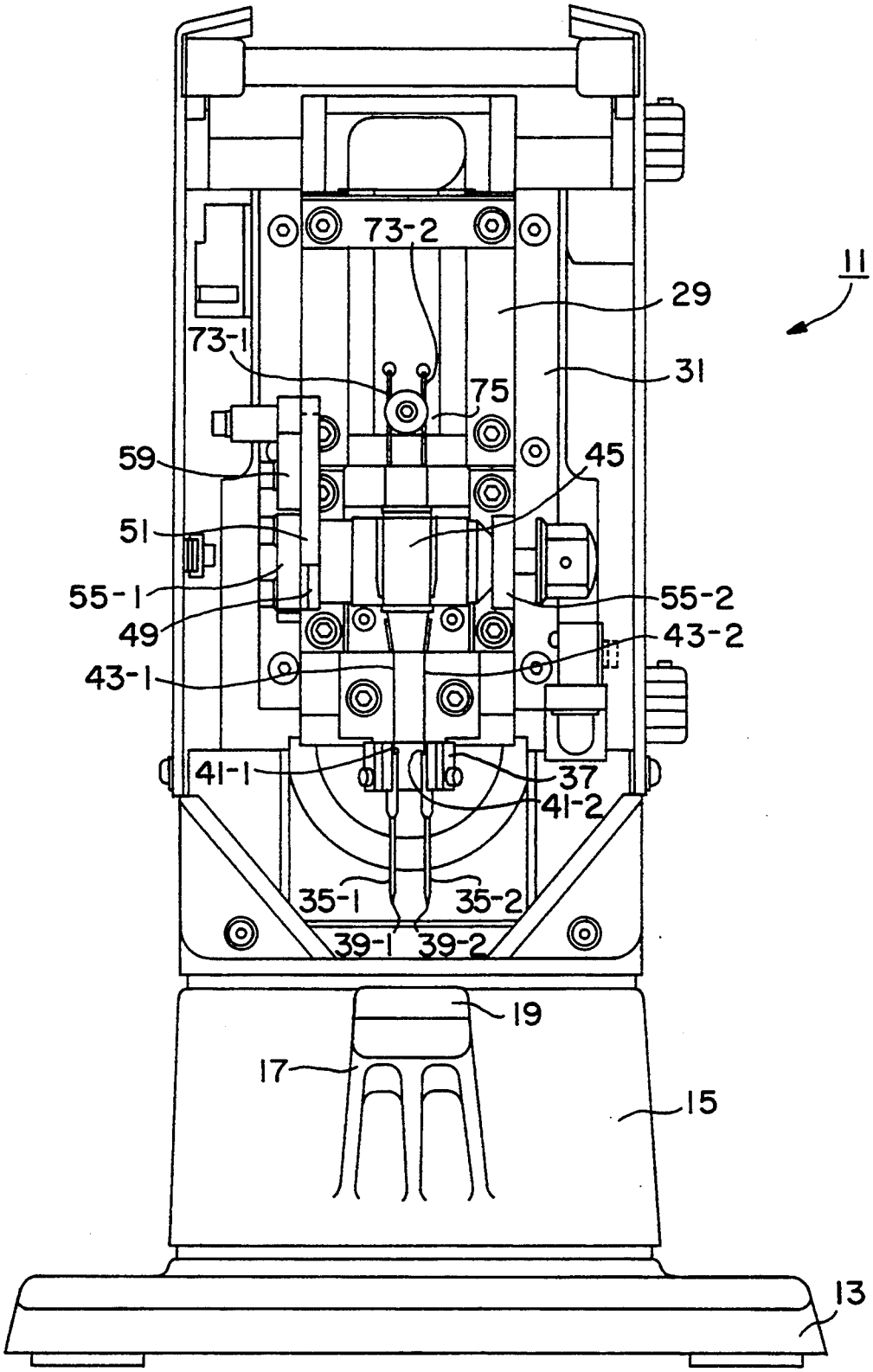
FIG. 3 is a front view of the device shown in FIG. 2, the device being shown with a front portion of its housing removed to reveal the components contained therewithin.

Referring now to FIGS. 2 and 3, there are shown side and front views, respectively of a device for dispensing attachments, the device being constructed according to the teachings of the present invention and represented generally by reference numeral 11. For simplicity and clarity, parts not directly pertaining to the invention are only diagrammatically sown in the drawings and are not described in detail below.

Figure 1A:
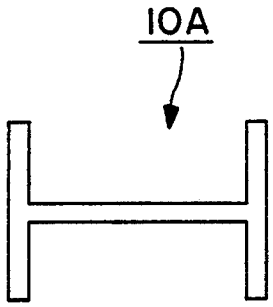
FIG. 1A is a plan view of one embodiment of an attachment which has been properly severed from a roll of continuously connected ladder stock.
Figure 1B:
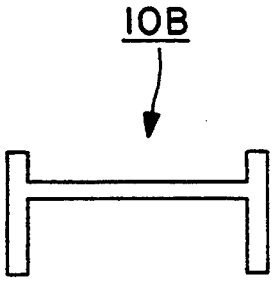
FIG. 1B is a plan view of the same type of attachment as shown in FIG. 1A, the attachment having been severed asymmetrically from a roll of continuously connected ladder stock.
Figure 6:
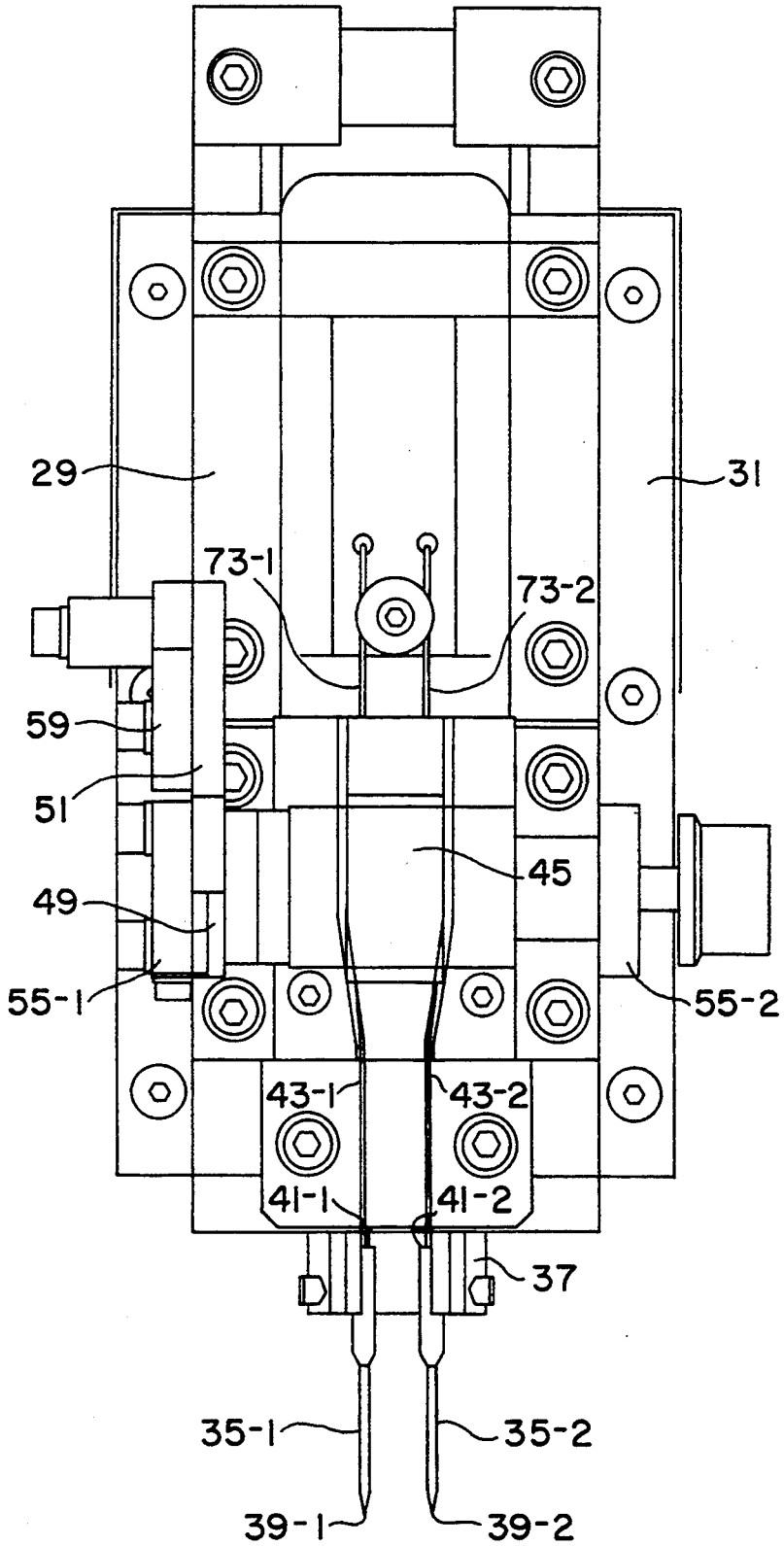
FIG. 6 is a fragmentary front view of the head and mount assemblies shown in FIG. 4.
Figure 7A:
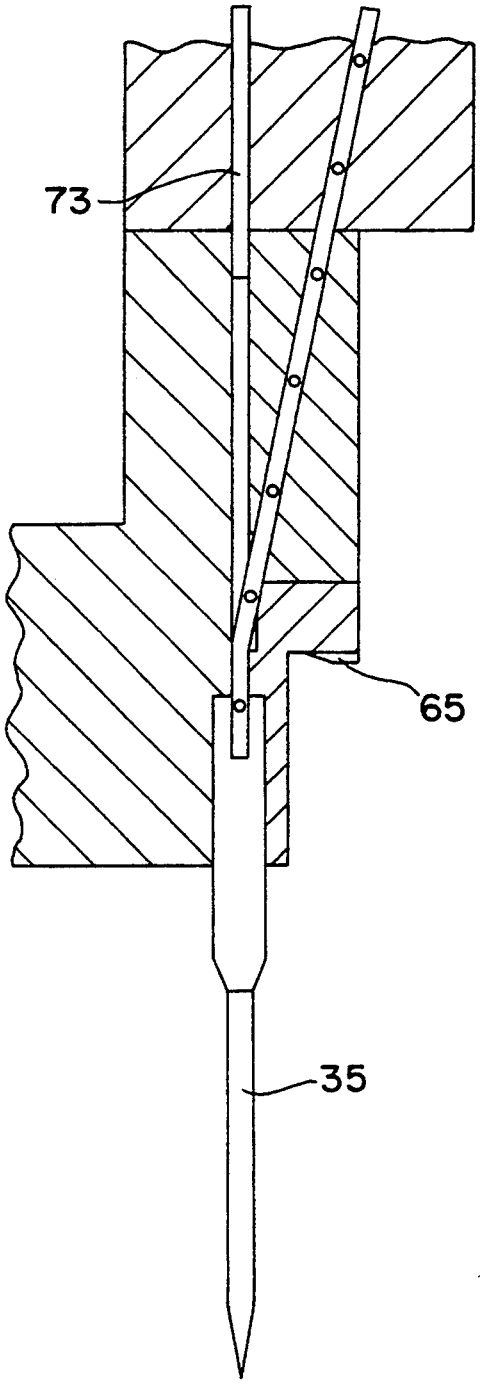
FIGS. 7(*a*) through 7(*g*) represent a series of views which depict schematically the sequence of feeding, severing and ejecting steps performed by the device of FIG. 2.
Figure 7B:
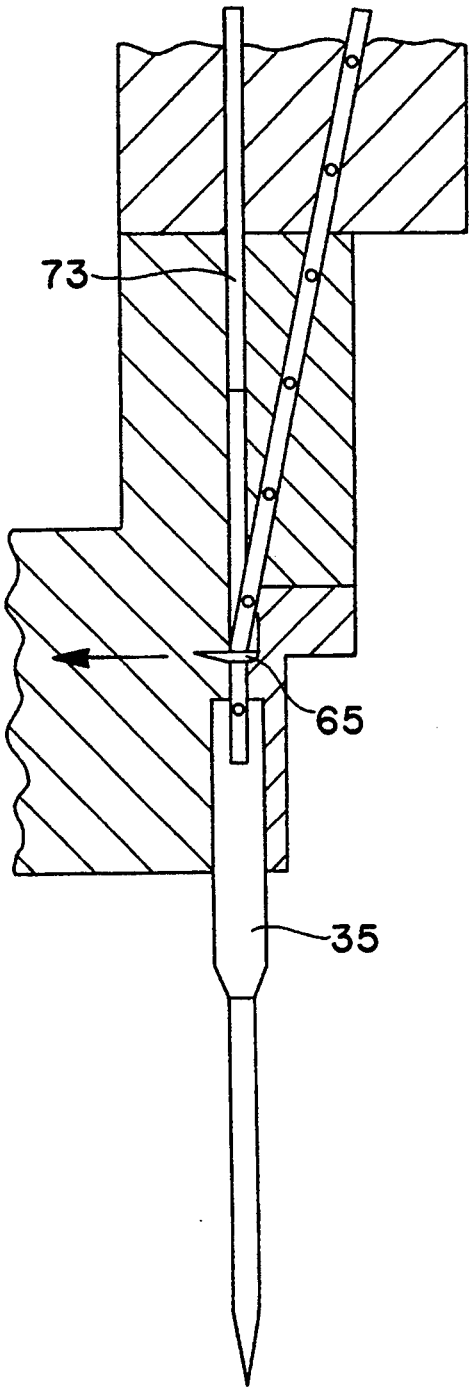
Figure 7C:
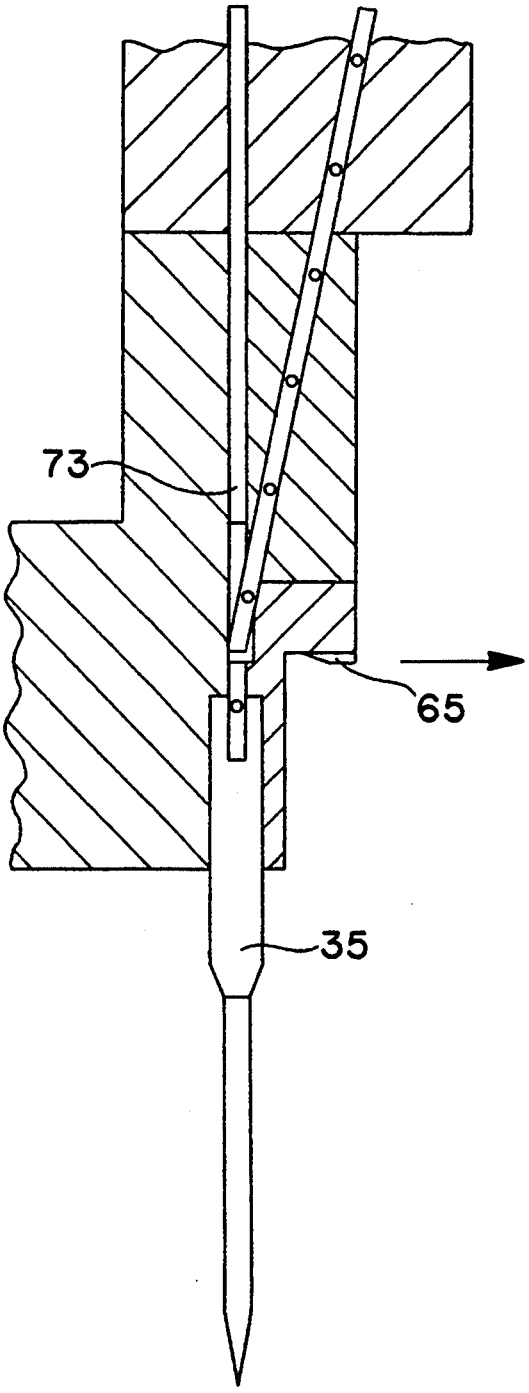
Figure 7D:
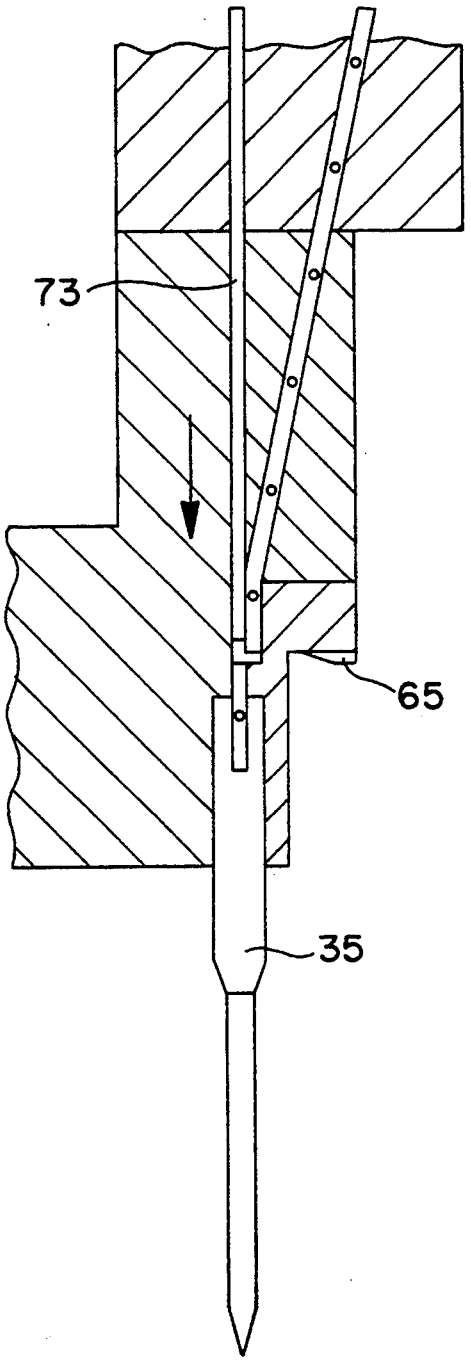
Figure 7E:
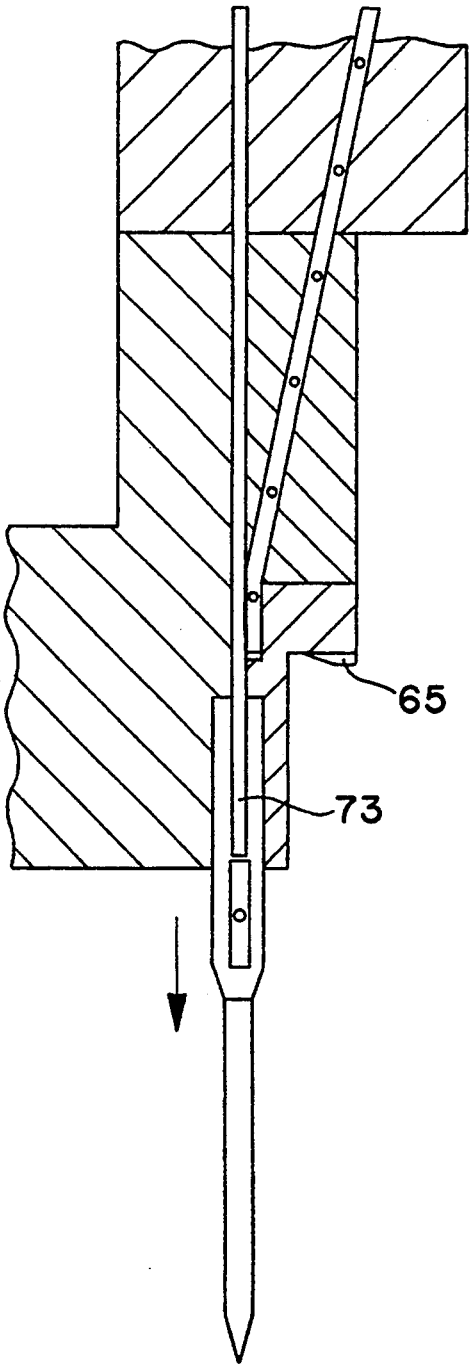
Figure 7F:
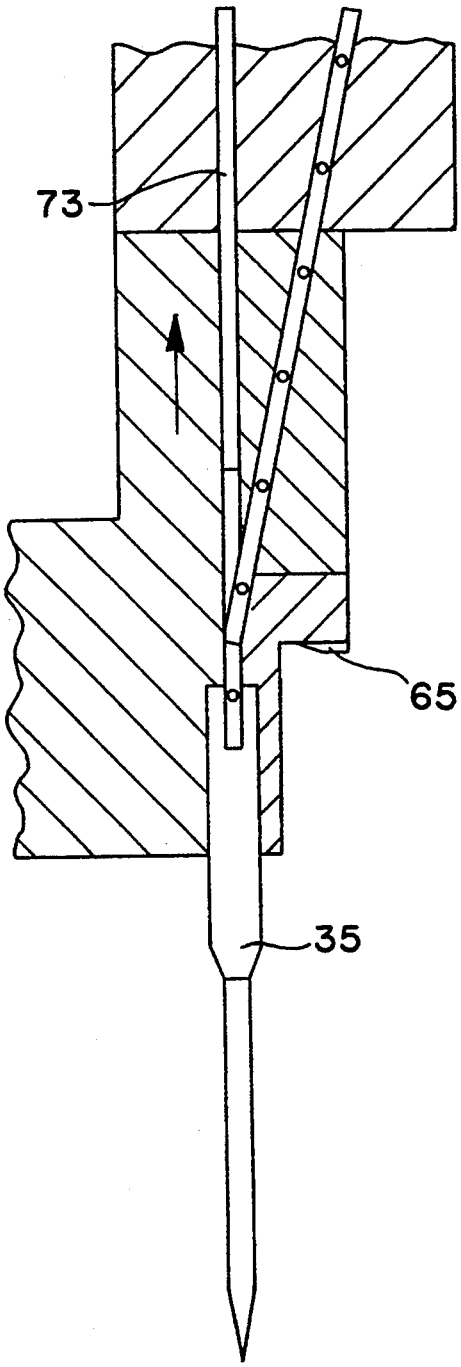
Figure 7G:
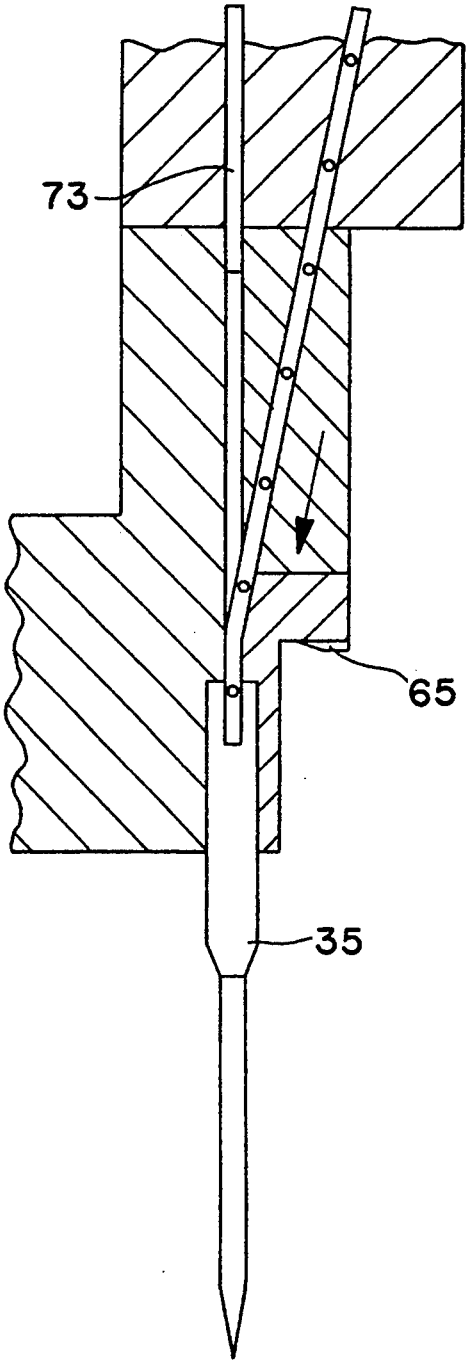

As is apparent from the description therein, device 11 is sued to sever individual attachments from continuously connected ladder stock and to dispense and attach such individual attachments to desired workpieces. The following described device is intended for use with attachments of the type consisting of two plastic side members coupled by a plastic crosslink (such as shown in FIG. 1A). As illustrated in FIGS. 3 and 6 and described below, the device 11 includes duplicates of various components (e.g. needles 35-1 and 35-2). However, the invention also encompasses dispensing and attaching devices useful with other types of attachments wherein only a single set of such components is provided.

As seen best in FIG. 2, device 11 includes a frame, the frame including a base 13, a neck 15, an arm 17 onto which a reactor plate 19 is mounted, and a housing 21.

A head assembly 23, comprising a head member 20, and a mount assembly 25, comprising a mount 31, are disposed within housing 21. Head member 29 is slidably mounted for vertical movement on mount 31, and as will be seen below, the sliding vertical movement of head member 29 relative to mount 31 is used to actuate the feeding, severing and ejecting mechanisms of device 11.

Also disposed within housing 21 is an electric motor assembly 27. Many of the components of motor assembly 27 are seated within mount 31 and are, therefore, not shown in FIG. 2; nevertheless, as can be seen from the following description, motor assembly 27 is generally similar in construction and operation to the arrangement disclosed in U.S. Pat. No. 4,877,172. Motor assembly 27 includes an electric motor 32 which, through a clutch (not shown), drives the vertical movement of head member 23 relative to mount 31. Actuation of the clutch by a solenoid assembly (not shown) is triggered through a foot operated switch (not shown). A crankarm (not shown) mounted on the clutch engages a yoke assembly 33 mounted on head member 29 (see FIG. 5). Clutch actuation allows for one full revolution other crankarm, which reciprocates head member 29 downward in the expulsion direction, and then in the withdrawal direction for a complete dispensing cycle.

Figure 4:
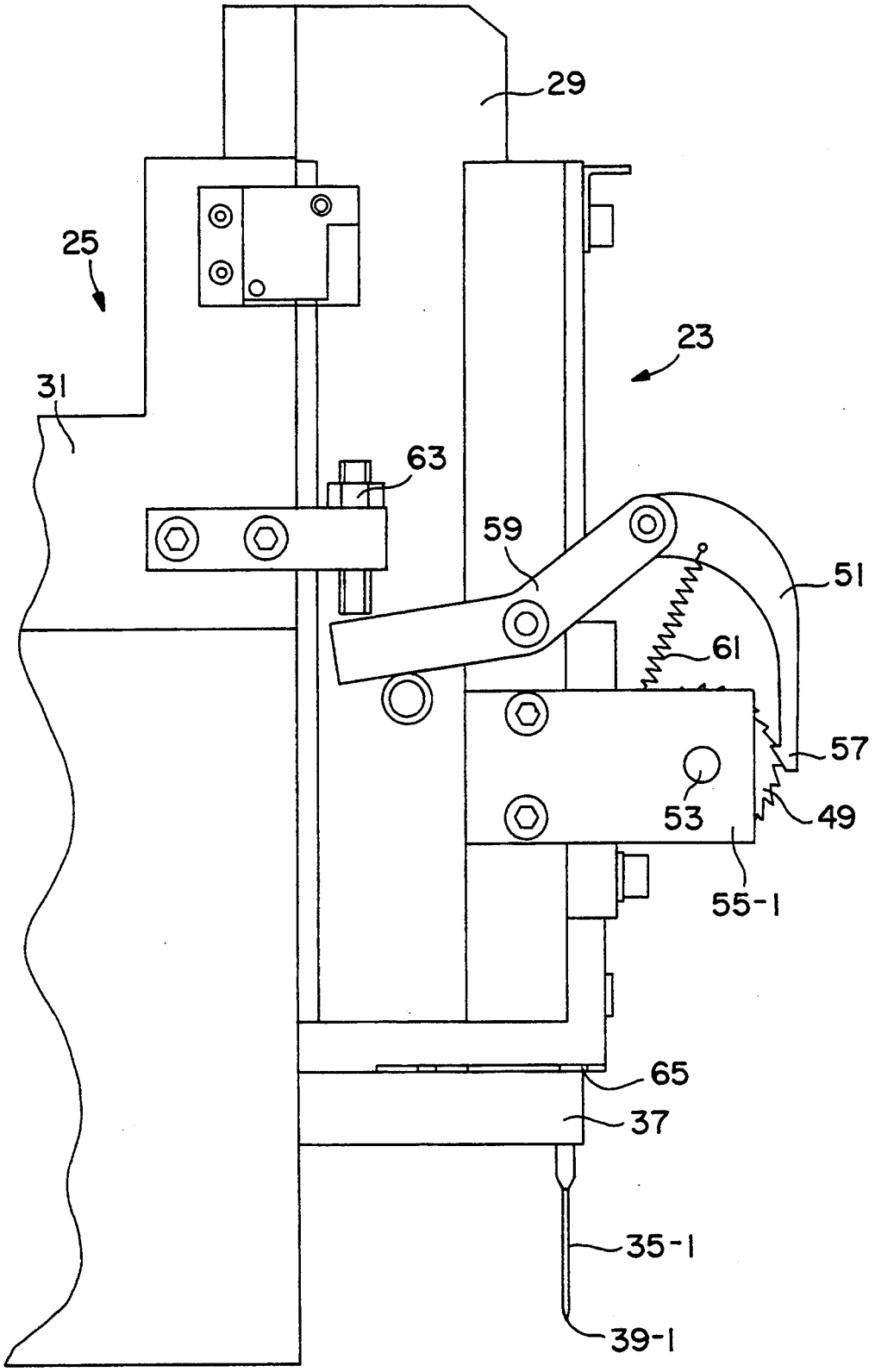
FIG. 4 is an enlarged fragmentary side view of the head and mount assemblies shown in FIG. 2.
Figure 5:
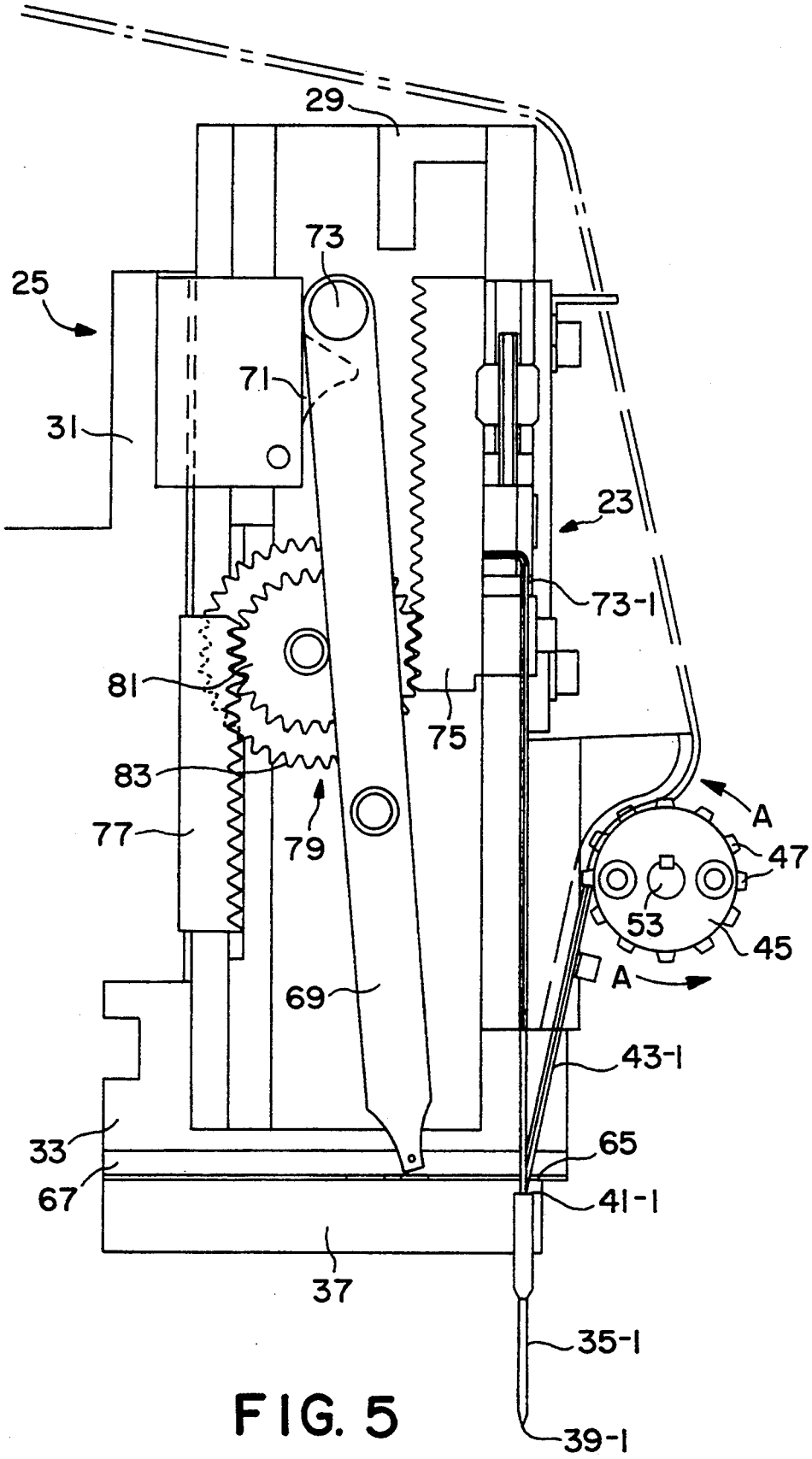
FIG. 5 is a fragmentary section view of the head and mount assemblies of the device shown in FIG. 4.

Referring now to FIGS. 4 through 6, portions of head assembly 23 and mount assembly 25 are shown in greater detail to illustrate the actuation and operation of the feeding, severing and ejecting mechanisms of device 11.

In addition to the above-described head member 29, head assembly 23 includes a pair of parallel hollow slotted needles 35-1 and 35-2. Needles 35 are attached to the bottom of head member 29 through a needle block 37. Each needle 35 is shaped to include a tip 39, a rear end 41 and a longitudinal axis extending therebetween and is oriented vertically so that its longitudinal axis is parallel to the direction in which head member 29 moves.

Head assembly 23 also includes a feeding mechanism for feeding ladder stock attachments through a pair of feed channels 43-1 and 43-2 and into needles 35. In the present embodiment, said feeding mechanism comprises a rotatably mounted feed wheel 45. Feed wheel 45 has special teeth 47 on its outer surface suitably configured to mate with and to drive ladder stock. As can be seen, feed channels 43-1 and 43-2 and feed wheel 45 are oriented relative to needles 35 so that, for reasons to be further discussed below, attachment may be inserted into needles 35 at appropriate angles relative to their respective longitudinal axes. Moreover, feed wheel 45 is preferably located a short distance from needles 35, e.g. approximately 1.125 inches as opposed to approximately 6 inches in the commercial embodiment of the device disclosed in U.S. Pat. No. 4,877,172, to minimize the risk that ladder stock will be advanced improperly to needles 35 and will be cut asymmetrically.

Rotation of feed wheel 45 in the direction indicated by arrows A in FIG. 5 is achieved with an arrangement comprising a ratchet 49 and a pawl 51. Ratchet 49 is coupled to feed wheel 45 by means of shaft 53. Shaft 53, in turn, is rotatably mounted on a pair of brackets 55-1 and 55-2 fixedly mounted on head member 29. Pawl 51, which has a first end 57 adapted to engage the teeth of ratchet 49, is pivotally connected at its opposite end to a lever 50 which, in turn, is fixedly mounted on head member 29. A spring 61, which is attached at one end to pawl 51 and at the other end to bracket 55-1, biases pawl 51 towards ratchet 49. A post 63 is fixedly mounted on mount 31 to act as a stop for lever 59.

The above-described ratchet and pawl arrangement works as follows to rotate feed wheel 45. With head member 29 still in the midst of withdrawing vertically upwardly, lever 59 comes into contact with and is stopped by post 63. The differential in deceleration between lever 59 and its pivotally connected pawl 51 causes pawl 51 to briefly pivot upwardly. As it pivots, pawl 51 engages ratchet 49 and causes its rotation, thereby causing feed wheel 45 to rotate similarly. Pawl 51 then resumes its previous orientation and is adapted to engage the next tooth of ratchet 49.

As seen best in FIG. 5, head assembly 23 additionally includes a knife 65 which is used to sever an attachment which has been loaded into needles 35 from the remainder of a length of ladder stock. Knife 65 is mounted on a knife block 67 which, in turn, is connected to a knife actuating arm 59. Arm 69, which is pivotally connected to head member 29, is desirably controlled by a cam 71 fixedly mounted on mount 31. Initial movement of head member 29 in the downward, i.e. expulsion, direction drives a roller 73 mounted on the end of arm 69 over cam 71. Cam 71 is disposed at an angle which causes arm 69 to pivot, thereby urging knife 65 to move in the severing direction. Arm 69 is desirably spring-loaded so that the blade is retracted immediately after severing. It will be appreciated that FIG. 5 merely represents one side of the head assembly; duplicates of arm 69 and cam 71 are not seen in FIG. 5.

Head assembly 23 further includes a pair of ejector rods 73-1 and 73-2 for expelling an individual attachment disposed within needles 35 out through their respective tips 39. Ejector rods 73-1 and 73-2, which are disposed along the longitudinal axes of needles 35-1 and 35-2, repetitively, are fixedly mounted on a rack 75 which, in turn, is slidably mounted for vertical movement on head member 29. Vertical movement of rack 75 is controlled by a stationary rack 77, which is fixedly mouted on mount 31, and a gear assembly 79. Gear assembly 79 comprises a first gear 81 engaged with stationary rack 77 and a second gear 83 of greater diameter engaged with rack 75. Gears 81 and 83 are fixed to each other and are rotatably mounted to move with head member 29. As head member 29 moves in the expulsion direction, the rotation of first gear 82 in interaction with stationary rack 77 turns second gear 83, thus driving rack 75 in the expulsion direction relative to head member 29 and causing ejector rods 73 to enter needles 35 though their respective rear ends 41.

Referring now to FIGS. 7(*a*) through 7(*g*), a series of schematic views are shown to illustrate the manner in which ladder stock attachments are fed, severed and ejected using device 11.

In FIG. 7(*a*), the lead attachment of a length of ladder stock is shown partially inserted into needle 35. As can be seen, the attachment has been fed into the needle at an angle so that its leading end is disposed along the longitudinal axis of the needle whereas its trailing end is bent off-axis. Knife 65 and ejector rod 73 are shown in their respective retracted positions.

In FIG. 7(*b*), knife 65 is shown severing the partially inserted attachment from the remainder of the ladder stock. Once the attachment has been severed, its trailing end springs into alignment with needle 35. Ejector rod 65 is shown advancing towards needle 35.

In FIG. 7(*c*), knife 65 is shown returning to its retracted position, the severed attachment and ladder stock remaining in the position where they were at the time of severance. Ejector rod 73 is shown continuing to advance towards needle 35.

In FIG. 7(*d*), ejector rod 73 is shown deflecting the leading end of the ladder stock as its travels towards needle 35.

In FIG. 7(*e*), ejector rod 73 is shown pushing the attachment through needle 35.

In FIG. 7(*f*), ejector rod 73 is shown returning to its retracted position, thereby allowing the leading end of the ladder stock to move back into position to be fed into needle 35.

In FIG. 7(*g*), the ladder stock is advanced so that the forwardmost attachment is partially inserted into needle 35 at an angle.

As can readily be appreciated from the above description, the angle at which attachments are fed into needle 35 should be great enough so that ejector rod 73 can be inserted into needle 35 by deflecting the leading end of the remainder of the ladder stock, without requiring that needle 35 be moved laterally relative to ejector rod 73 and/or the ladder stock. At the same time, the angle should be small enough to permit the ladder sock to be easily inserted into needle 35 through its rear end.

The embodiments of the present invention are intended to be merely exemplary and those skilled in the art shall be able to make numerous variations and modifications to bit without departing from the spirit of the present invention. All such variations and modifications are intended to be within the scope of the present invention as defined in the appended claims.

What is claimed is;

1. A device for dispensing attachments from a plurality of interconnected attachments comprising:

a) a hollow slotted needle having a tip, a rear end and a longitudinal axis;

b) a feed channel through which said plurality of interconnected attachments are fed, said feed channel being oriented at an acute angle relative to said longitudinal axis of said hollow slotted needle, c) a feed wheel for feeding at least a part of said plurality of interconnected attachments through said feed channel into said hollow slotted needle through said rear end;

d) means for severing an individual attachment to be dispensed from said plurality of interconnected attachments after said attachment to be dispensed has been only partially inserted into said hollow slotted needle; and e) means for ejecting said attachment to be dispensed from said hollow slotted needle through said tip after said attachment has been severed from said plurality of interconnected attachments;

f) said ejecting means being fixed from lateral movement relative to said hollow slotted needle.

2. The device as claimed in claim 1 wherein said ejecting means comprises an ejector rod movable along said longitudinal axis of said hollow slotted needle.

3. The device as claimed in claim 1 wherein said feed wheel is disposed approximately 1.125 inches from said rear end of said hollow slotted needle.

4. The device of claim 1, wherein said device further includes a mount disposed vertically below said hollow slotted needle and said hollow slotted needle is movable vertically up and down relative to said mount and is fixed with regard to lateral movement relative to said mount.

5. The device of claim 4 and further including a pawl and ratchet for driving said feed wheel.

6. The device of claim 5 and wherein the severing means is a knife.

7. The device of claim 1, wherein said device further includes a vertically movable head member and wherein the feed wheel, the severing means and the ejecting means are all mounted on the vertically movable head member.

* * * * *